US009368863B2

(12) United States Patent
Kwon

(10) Patent No.: US 9,368,863 B2
(45) Date of Patent: Jun. 14, 2016

(54) ANTENNA DEVICE AND ELECTRONIC DEVICE HAVING THE SAME

(71) Applicant: Samsung Electronics Co., Ltd., Suwon-si, Gyeonggi-do (KR)

(72) Inventor: Ohyong Kwon, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 202 days.

(21) Appl. No.: 14/290,228

(22) Filed: May 29, 2014

(65) Prior Publication Data

US 2014/0354505 A1 Dec. 4, 2014

(30) Foreign Application Priority Data

May 29, 2013 (KR) ..... 10-2013-0061326

(51) Int. Cl.
*H01Q 1/24* (2006.01)
*H01Q 1/48* (2006.01)
*H01Q 9/04* (2006.01)

(52) U.S. Cl.
CPC ..... *H01Q 1/48* (2013.01); *H01Q 1/243* (2013.01); *H01Q 9/0407* (2013.01); *H01Q 9/0442* (2013.01)

(58) Field of Classification Search
CPC ..... H01Q 1/46; H01Q 1/48; H01Q 1/243; H01Q 9/0407; H01Q 9/0442
USPC ..... 343/846, 848, 702
See application file for complete search history.

(56) References Cited

U.S. PATENT DOCUMENTS

| | | | | |
|---|---|---|---|---|
| 7,450,072 | B2 * | 11/2008 | Kim | H01Q 1/243 343/700 MS |
| 2008/0079635 | A1 | 4/2008 | Rowell | |
| 2012/0062434 | A1 | 3/2012 | Kim et al. | |
| 2012/0218163 | A1 | 8/2012 | Wong et al. | |
| 2012/0274532 | A1 | 11/2012 | Kurashima et al. | |

FOREIGN PATENT DOCUMENTS

| | | | |
|---|---|---|---|
| JP | 2004228861 | A | 8/2004 |
| KR | 1020070063958 | A | 6/2007 |
| KR | 100813313 | B1 | 3/2008 |
| KR | 1020090081162 | A | 7/2009 |
| KR | 1020100095910 | A | 9/2010 |
| KR | 1020100098197 | A | 9/2010 |
| KR | 1020100106164 | A | 10/2010 |
| KR | 1020100123307 | A | 11/2010 |
| KR | 1020110019666 | A | 2/2011 |
| KR | 1020110073403 | A | 6/2011 |
| KR | 1020110096021 | A | 8/2011 |

* cited by examiner

*Primary Examiner* — Hoang V Nguyen
(74) *Attorney, Agent, or Firm* — Jefferson IP Law, LLP

(57) ABSTRACT

An electronic device with an antenna device is provided. The electronic device include a radiator configured to transmit/receive an electromagnetic wave, a ground portion connected to one end of the radiator, the ground portion configured to conduct current such that a current corresponding to an opposite polarity of a current, which flows in the radiator, flowing in the ground portion, an expanded ground extending from a part of the ground portion, and a ground path extending from the ground portion to a region adjacent to the expanded ground so as to cause current to flow from the ground portion through a current path corresponding to the length of the radiator.

13 Claims, 7 Drawing Sheets

ANTENNA DEVICE AND ELECTRONIC DEVICE HAVING THE SAME

CROSS-REFERENCE TO RELATED APPLICATION(S)

This application claims the benefit under 35 U.S.C. §119 (a) of a Korean patent application filed on May 29, 2013 in the Korean Intellectual Property Office and assigned Serial number 10-2013-0061326, the entire disclosure of which is hereby incorporated by reference.

TECHNICAL FIELD

The present disclosure relates to antenna device and an electronic device having the same. More particularly, the present disclosure relates to an antenna which has an optimum arrangement form in a restrictive space structure and is capable of preventing a distortion phenomenon of an antenna characteristic due to interference of a neighboring electric object and a neighboring circuit object and compensating a changed resonance frequency antenna, and an electronic device having the same.

BACKGROUND

In general, electronic devices are provided with various kinds of wireless communication units so as to perform wireless communication functions. In addition, the wireless communication units perform the wireless communication functions with an external counterpart through corresponding antennas. For example, nowadays, a portable terminal is provided with, for example, a communication unit for wireless communication with a base station (e.g., LongTerm Evolution (LTE), Wideband Code Division Multiple Access (WCDMA), and/or the like), a communication unit for connection with an Internet network (e.g., WiFi, Wibro, Wimax, and/or the like), a communication unit for a short-range communication (e.g., Bluetooth, Near field communication (NFC), and/or the like), a Global Positioning System (GPS) reception unit, and/or the like. The above-mentioned communication units should be provided with antennas for conducting wireless communication with an external counterpart. For example, nowadays, a portable terminal should be provided with a plurality of antennas for conducting a wireless communication function with an external counterpart. Accordingly, miniaturization of the antennas in order to mount a plurality of antennas in the portable terminal is required.

A Planner Inverted F Antenna (hereinafter, referred to as a "PIFA") is a compact antenna. A PIFA antenna used in the portable terminal requires a physical length corresponding to ¼ of a wavelength of a use frequency ($\lambda=c/(f\sqrt{\epsilon})$). For example, a GPS (e.g., 1.575 GHz band) antenna requires a physical length of 4.7 cm in air, an LTE (e.g., 700 MHz band) antenna requires a physical length of 10.7 cm. Accordingly, nowadays, a portable terminal which should support various wireless communication functions has a problem in that the space occupied by the antennas becomes larger, which makes producing the portable terminal in a compact size difficult. Further, because resonance of an antenna is determined by the physical length of the antenna, there is a problem in that tuning at the time of proceeding development, for example, mold correction, needs much time.

A recently launched smart phone is equipped with an input/output connector for data transmission at the lower end thereof. This is a structure provided considering a user's convenience in using the smart phone and a design of the smart phone and has various advantages. However, due to the connector structure equipped at the lower end, there are problems in that an antenna radiation region positioned at the lower end may be narrowed by being blocked by an electric object or a circuit object and a malfunction may occur under the influence of a neighboring metallic object.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device capable of solving a problem of degradation of an antenna which is caused when various electric objects, circuit objects, and/or the like encroach a basic radiation region of the antenna in the process of designing an electronic device and an electronic device having the antenna.

In accordance with an aspect of the present disclosure, an electronic device with an antenna device is provided. The electronic device includes a radiator configured to transmit/receive an electromagnetic wave, a ground portion connected to one end of the radiator, the ground portion configured to conduct current such that a current corresponding to an opposite polarity of a current, which flows in the radiator, flows in the ground portion, an expanded ground extending from a part of the ground portion, and a ground path extending from the ground portion to a region adjacent to the expanded ground so as to cause current to flow from the ground portion through a current path corresponding to the length of the radiator.

In accordance with another aspect of the present disclosure an antenna device is provided. The antenna device includes a radiator configured to transmit/receive an electromagnetic wave, a ground portion connected to one end of the radiator, the ground portion configured to conduct current such that a current corresponding to an opposite polarity of a current, which flows in the radiator, flowing in the ground portion, and a ground path arranged to be adjacent to a region at which a part of the ground portion is expanded so as to cause the current flowing from the ground portion to flow to a new current path before being distributed by the expanded region.

An antenna according to the present disclosure and an electronic device having the same forms a new ground path extending from the ground of the antenna in a state in which an expanded ground is arranged adjacent to the antenna so as to mount an electric object or an circuit object so that the current flowing in the ground of the antenna smoothly flows through the current path before being dispersed by the expanded ground. As a result, a distortion phenomenon of an antenna characteristic may be prevented.

In addition, according to the present disclosure, an impedance may be controlled by adjusting the length of the ground path using a lumped element added to the ground path such as an inductor or a capacitor.

Further, according to the present disclosure, a resonance frequency may be tuned using interaction between the ground path and the expanded ground.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

The same reference numerals are used to represent the same elements throughout the drawings.

DETAILED DESCRIPTION

Figure 1A:
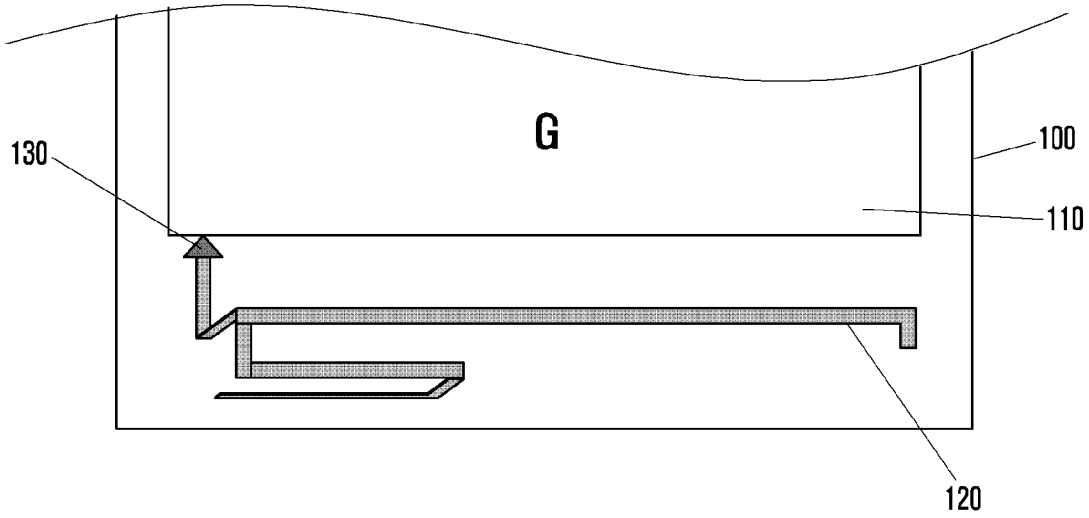
FIGS. 1A and 1B are views illustrating configurations of ordinary electronic device antennas according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the following descriptions, specific items such as a length, a size, a frequency of an antenna are presented so as to help general understanding of the present disclosure. However, it is obvious to a person ordinarily skilled in the art that the present disclosure may be carried out without the specific items. In addition, in the following description of the present disclosure, a detailed description of known functions and configurations incorporated herein will be omitted when it may make the subject matter of the present disclosure rather unclear.

According to various embodiments of the present disclosure, an electronic device may include communication functionality. For example, an electronic device may be a smart phone, a tablet Personal Computer (PC), a mobile phone, a video phone, an e-book reader, a desktop PC, a laptop PC, a netbook PC, a Personal Digital Assistant (PDA), a Portable Multimedia Player (PMP), an mp3 player, a mobile medical device, a camera, a wearable device (e.g., a Head-Mounted Device (HMD), electronic clothes, electronic braces, an electronic necklace, an electronic appcessory, an electronic tattoo, or a smart watch), and/or the like.

According to various embodiments of the present disclosure, an electronic device may be a smart home appliance with communication functionality. A smart home appliance may be, for example, a television, a Digital Video Disk (DVD) player, an audio, a refrigerator, an air conditioner, a vacuum cleaner, an oven, a microwave oven, a washer, a dryer, an air purifier, a set-top box, a TV box (e.g., Samsung HomeSync™, Apple TV™, or Google TV™), a gaming console, an electronic dictionary, an electronic key, a camcorder, an electronic picture frame, and/or the like.

According to various embodiments of the present disclosure, an electronic device may be a medical device (e.g., Magnetic Resonance Angiography (MRA) device, a Magnetic Resonance Imaging (MRI) device, Computed Tomography (CT) device, an imaging device, or an ultrasonic device), a navigation device, a Global Positioning System (GPS) receiver, an Event Data Recorder (EDR), a Flight Data Recorder (FDR), an automotive infotainment device, a naval electronic device (e.g., naval navigation device, gyroscope, or compass), an avionic electronic device, a security device, an industrial or consumer robot, and/or the like.

According to various embodiments of the present disclosure, an electronic device may be furniture, part of a building/structure, an electronic board, electronic signature receiving device, a projector, various measuring devices (e.g., water, electricity, gas or electro-magnetic wave measuring devices), and/or the like that include communication functionality.

According to various embodiments of the present disclosure, an electronic device may be any combination of the foregoing devices. In addition, it will be apparent to one having ordinary skill in the art that an electronic device according to various embodiments of the present disclosure is not limited to the foregoing devices.

According to various embodiments of the present disclosure, a portable terminal may be an electronic device.

Various embodiments of the present disclosure relate to an antenna device used in a portable terminal that supports various wireless communication functions (e.g., LTE, GPS, BT, WIFI, and/or the like). An antenna device according to an embodiment of the present disclosure has a configuration in which a electric circuit is connected to opposite ends and/or a power feeding point of a predetermined pattern (printed or made as an iron structure) printed on a Printed Circuit Board (PCB) or formed on a structural object such as a carrier and a lumped element for impedance matching is used. In addition, a distance between an expanded ground and a new ground path is adjusted for resonance frequency tuning.

The antenna device according to various embodiments of the present disclosure connects the lumped element to a ground path of an antenna so that both the electrical wavelength and the input impedance may be improved, thereby reducing an antenna space. In addition, resonance frequency tuning may be easily conducted without an additional element by conducting the tuning of the antenna resonance point by adjusting a spacing distance between the ground path of the antenna and an adjacent expanded ground.

Figure 1B:
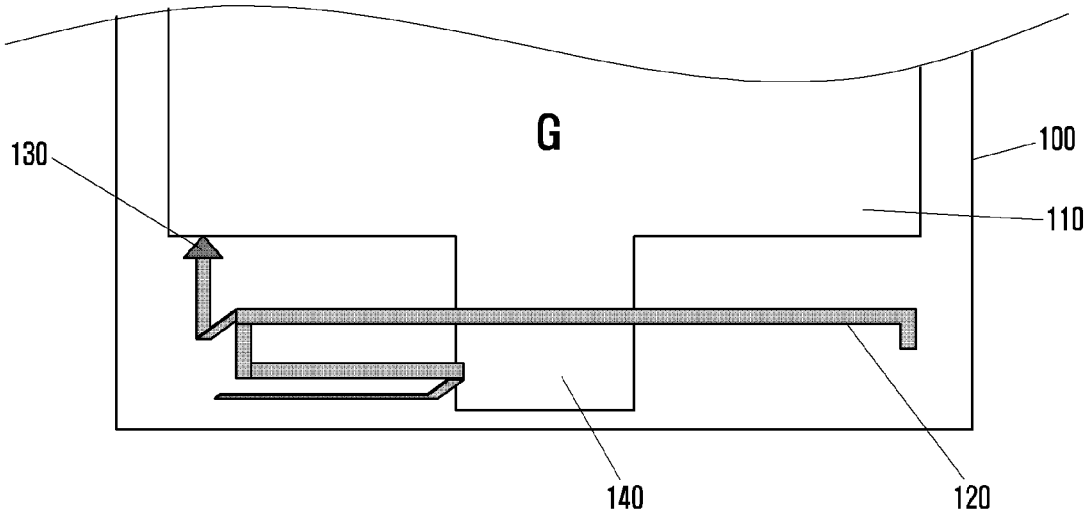
Figure 2:
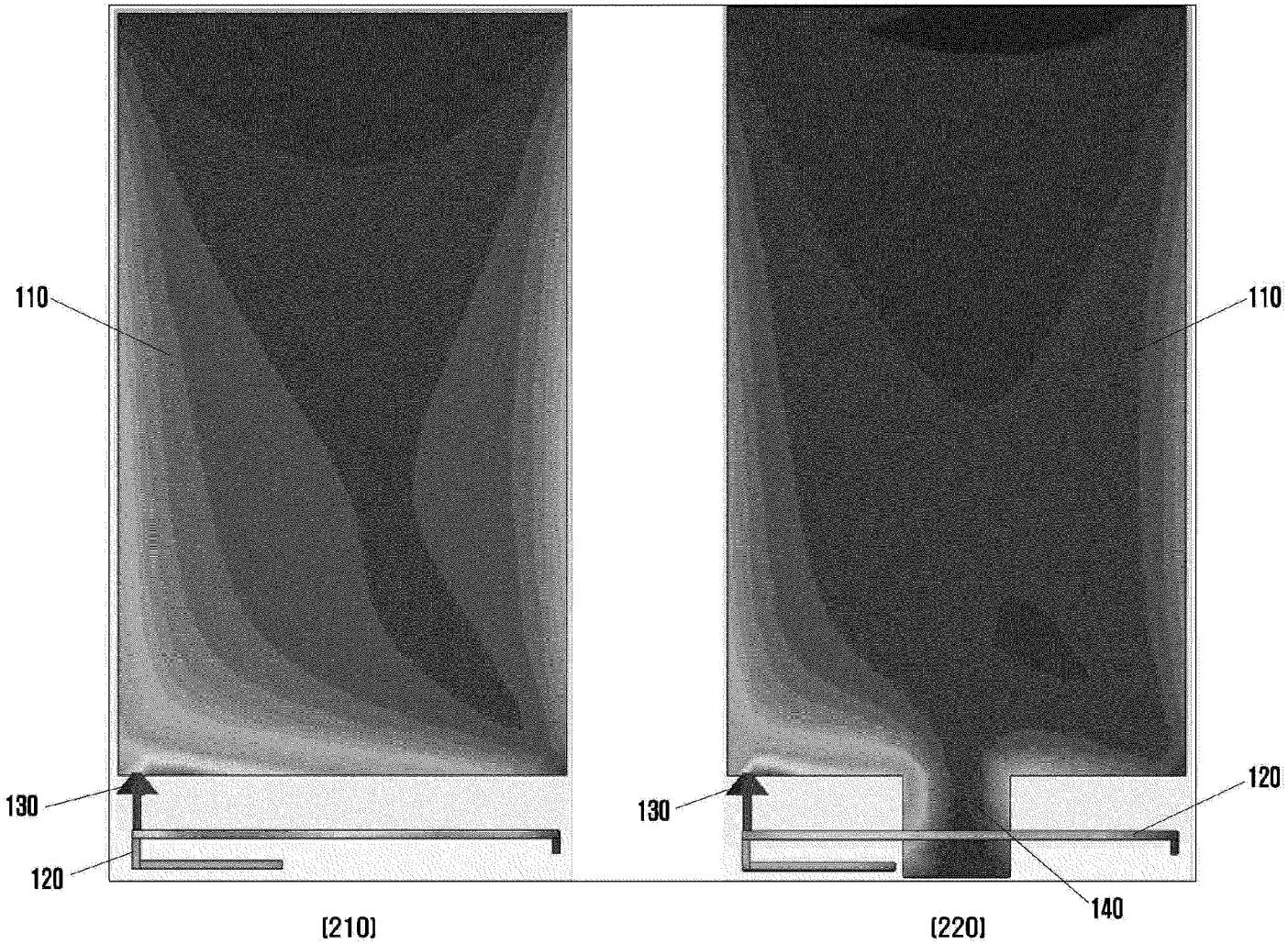
FIG. 2 is a view illustrating a distribution of currents flowing due to each antenna structure illustrated in FIGS. 1A and 1B according to an embodiment of the present disclosure.
Figure 3:
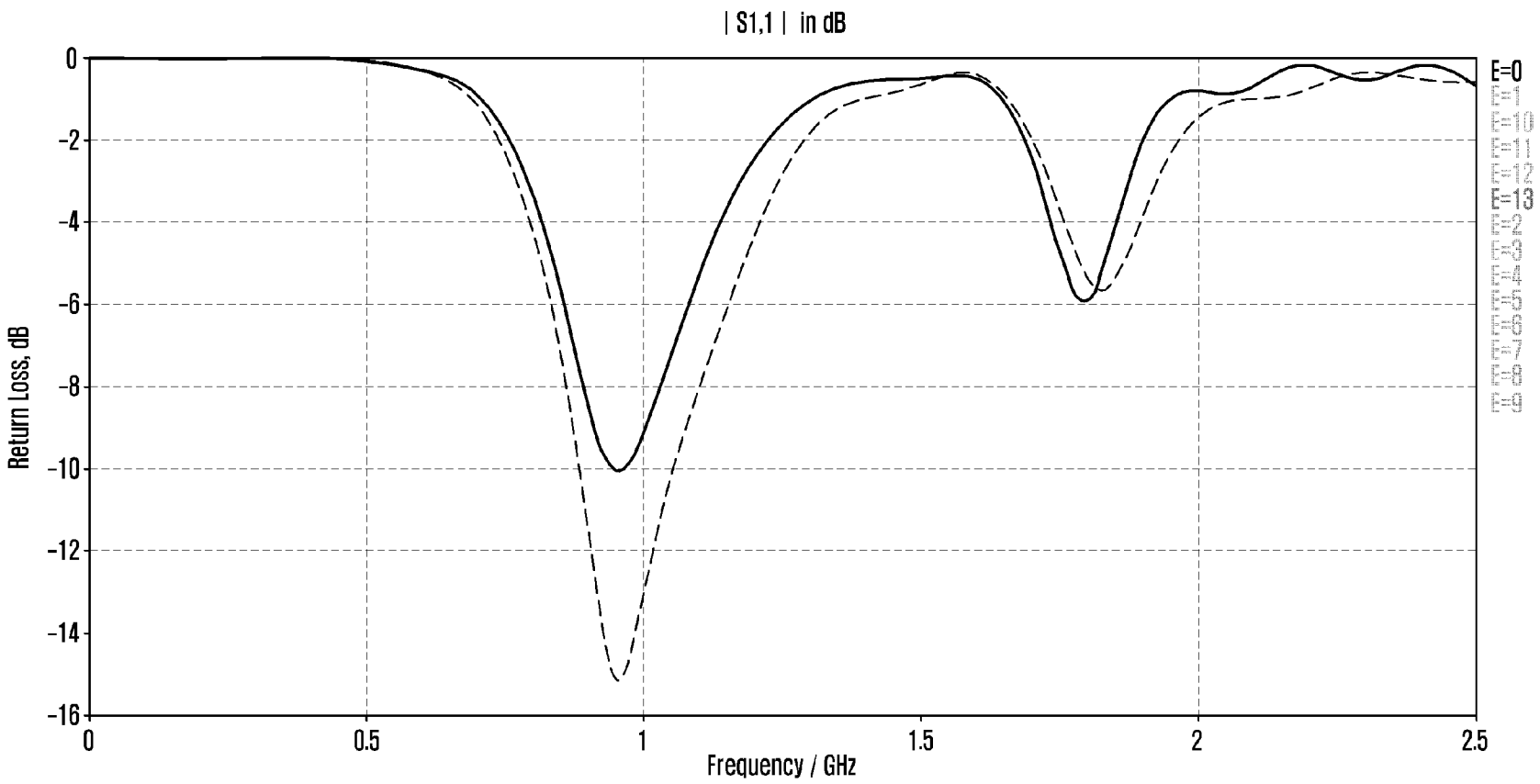
FIG. 3 is a graph that compares resonance frequencies of respective antennas illustrated in FIGS. 1A and 1B according to an embodiment of the present disclosure.

FIGS. 1A and 1B are views illustrating configurations of ordinary electronic device antennas according to an embodiment of the present disclosure. FIG. 2 is a view illustrating a distribution of currents flowing due to each antenna structure illustrated in FIGS. 1A and 1B according to an embodiment of the present disclosure. FIG. 3 is a graph that compares resonance frequencies of respective antennas illustrated in FIGS. 1A and 1B according to an embodiment of the present disclosure.

Referring to FIG. 1A, an electronic device is provided with a PCB substrate 100 on which various circuit objects and electric objects are mounted, and a narrow internal space of the electronic device is used as a measure of disposing an antenna device 120 using an empty space at a lower end of the PCB substrate 100. However, a smart phone according to the related art employs a structure in which a connector for data transmission is mounted at the lower end of the PCB substrate 100 considering a user's convenience in use and a design. Referring to FIG. 1B, in order to mount such a connector, an expanded ground 140 is added at the lower end of a ground portion 110 of the PCB substrate 100 as illustrated in FIG. 1B.

The distribution of currents flowing in the radiator 120 and the ground portion 110 when power is fed to the antenna illustrated in FIG. 1A is as shown in the current distribution diagram 210 at the left of FIG. 2.

When a current flows in the radiator 120, the current also flows in the ground portion 110 due to a propagation effect (e.g., a skin effect). The skin effect refers to an increase phenomenon of electric specific resistance which is observed when induction logging is conducted in a highly conductive material such as the radiator 120. The skin effect may occur by interaction between adjacent medium loops when an induction current of a considerable magnitude flows in the medium loops due to the high conductivity. An induced magnetic field generated by the current of the medium loops induce an additional eddy current in a neighboring medium loop, which may occur to be overlapped with an induced magnetic field by a transmission coil.

As a result of such a phenomenon, a current corresponding to the opposite polarity of the current flowing in the radiator 120 is caused to flow in the ground portion 110 and the ground portion 110 where the opposite polarity current flows plays a role corresponding to an antenna radiator length value. As a result, a monopole antenna may implement an antenna only with a half length as compared with a dipole antenna and needs only a half space. As a result, the miniaturization of the antenna may be implemented.

When power is fed to the antenna illustrated in FIG. 1B, the distribution of currents flowing in the radiator 120 and the ground portion 110 are as shown in the current distribution diagram 220 at the right side of FIG. 2. For example, the ground portion 110 is expanded to the region in which the antenna is provided for mounting a connector at the lower end of the electronic device, the current which has flowed through the ground portion 110 is distributed at the expanded ground 140 and does not flow continuously and smoothly through the ground portion 110. In other words, a change in antenna length value by the current that has flown through the ground portion 110 is caused. Consequently, a problem may occur in that the antenna does not resonate at a pre-set resonance frequency and a reflection coefficient is increased in the corresponding frequency band.

Referring to FIG. 3, the reflection coefficient of the antenna illustrated in FIG. 1A is represented by a dot line graph, and the reflection coefficient of the antenna illustrated in FIG. 1B is represented by a solid line graph. For example, the dot line graph represents the reflection coefficient of the antenna when the ground is not expanded to a neighboring region and the solid line graph represents the reflection coefficient of the antenna when the ground 140 is expanded.

Referring to the GSM 900 MHz band in the graphs, the reflection of the antenna of FIG. 1B represented by the solid line is higher than the reflection of the antenna of FIG. 1A. The difference between the reflection of the antenna FIG. 1B and the reflection of antenna FIG. 1A is caused because the current that has flown in the ground portion 110 is distributed without smoothly flowing due to the addition of the expanded ground 140 and thus, the antenna does not resonate at the pre-set resonance frequency, thereby causing reflection. Accordingly, it may be appreciated that as compared with the antenna of FIG. 1A, the antenna gain corresponding to the antenna structure of FIG. 1B decreases.

The reflection coefficient is not substantially improved even if the length of the radiator 120 is changed or a matching unit that matches the antenna and the impedance of a transmission line is tuned at any way in order to solve the problem caused due to the expanded ground 140 as described above.

The lack of improvement in the reflection coefficient is because a dominant factor, which overturns the impedance matching control function obtained through the change of the length of the radiator and the tuning of the matching unit, controls the current flow of the antenna. The important factor that governs the current flow of the antenna is the expanded ground 140 added so as to mount the electric object and the circuit object.

Typically, an input/output connector is mounted on the expanded ground 140. The connector is disposed substantially correctly at the center of the lower end of the electronic device due to the user's convenience in use and design and is an element of which the position is difficult to move for ensuring the performance of the antenna or the like.

Accordingly, various embodiments of the present disclosure provide an antenna structure capable of preventing a distortion phenomenon of an antenna characteristic without moving the arrangement of the antenna even though the connector is mounted at the lower end of the electronic device.

Figure 4:
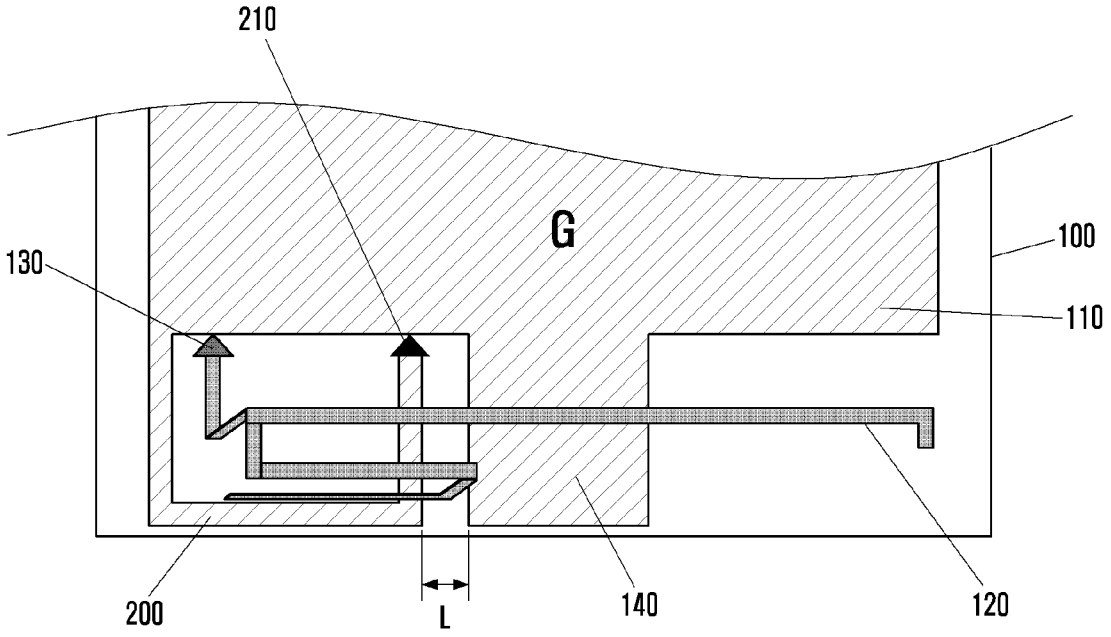
FIG. 4 is a view illustrating an antenna structure according to an embodiment of the present disclosure.
Figure 5:
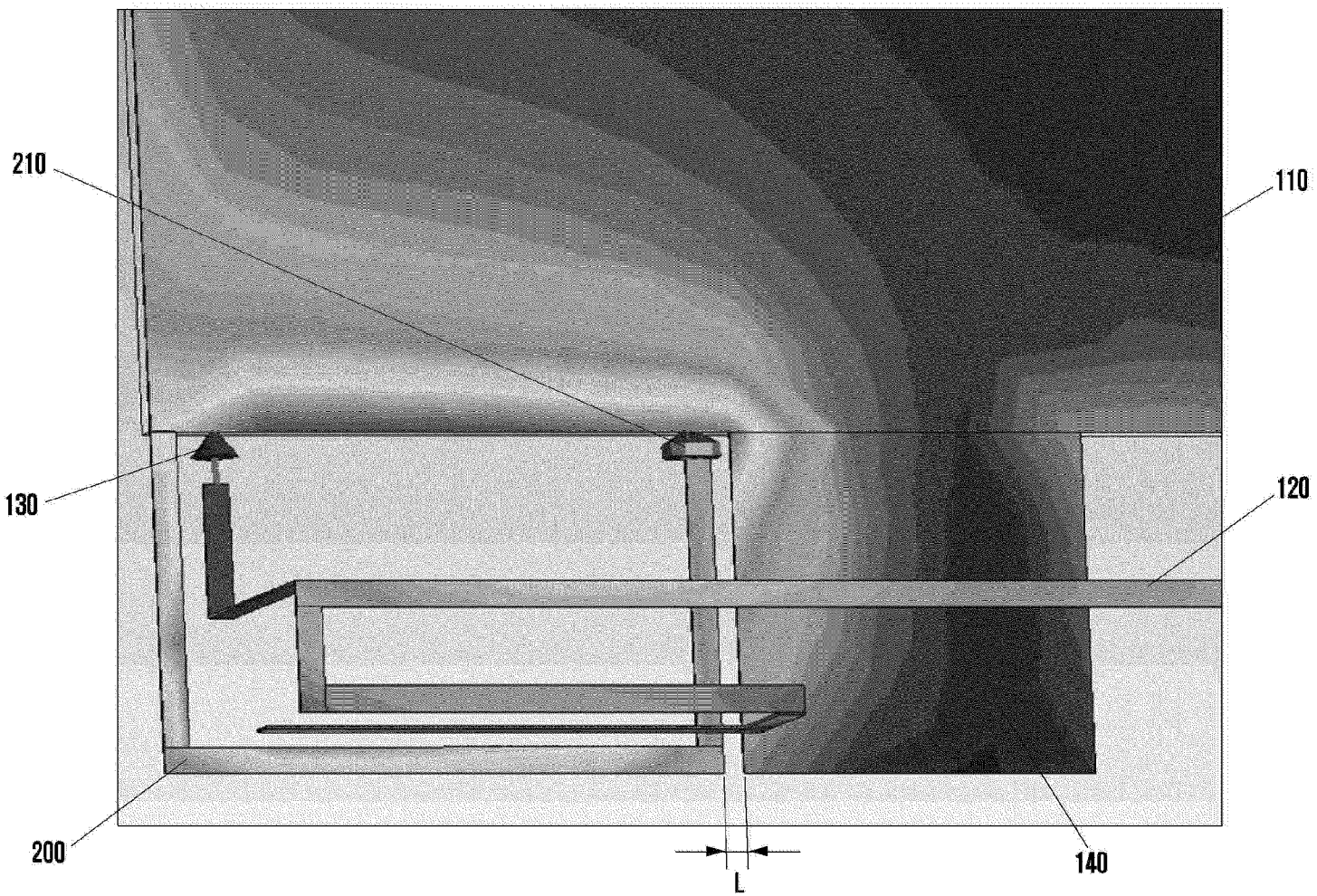
FIG. 5 is a view illustrating a distribution of currents at a time of antenna radiation according to an embodiment of the present disclosure.
Figure 6:
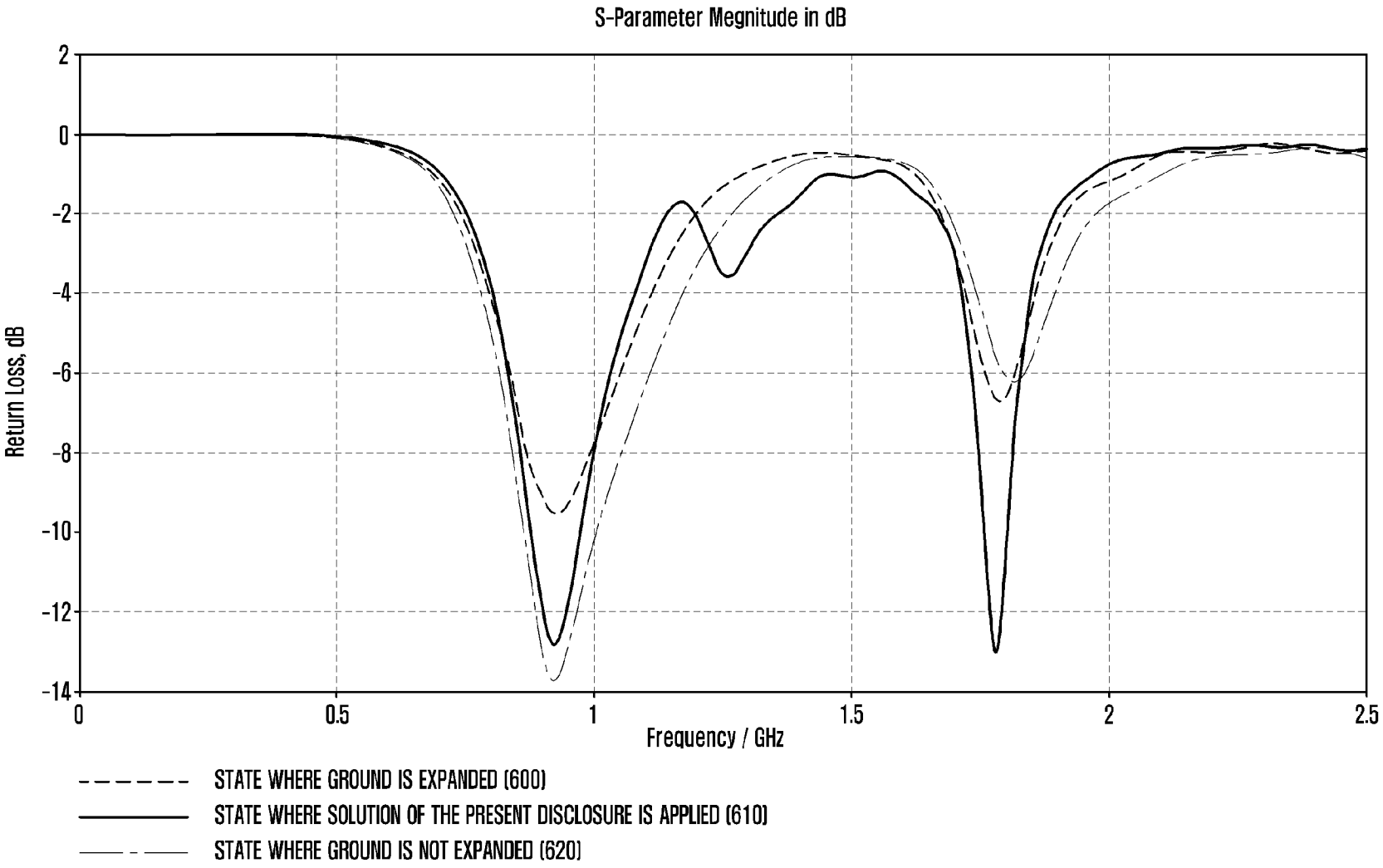
FIG. 6 is a graph that compares a resonance frequency of an antenna according to an embodiment of the present disclosure with a resonance frequency of an antenna according to the related art.
Figure 7:
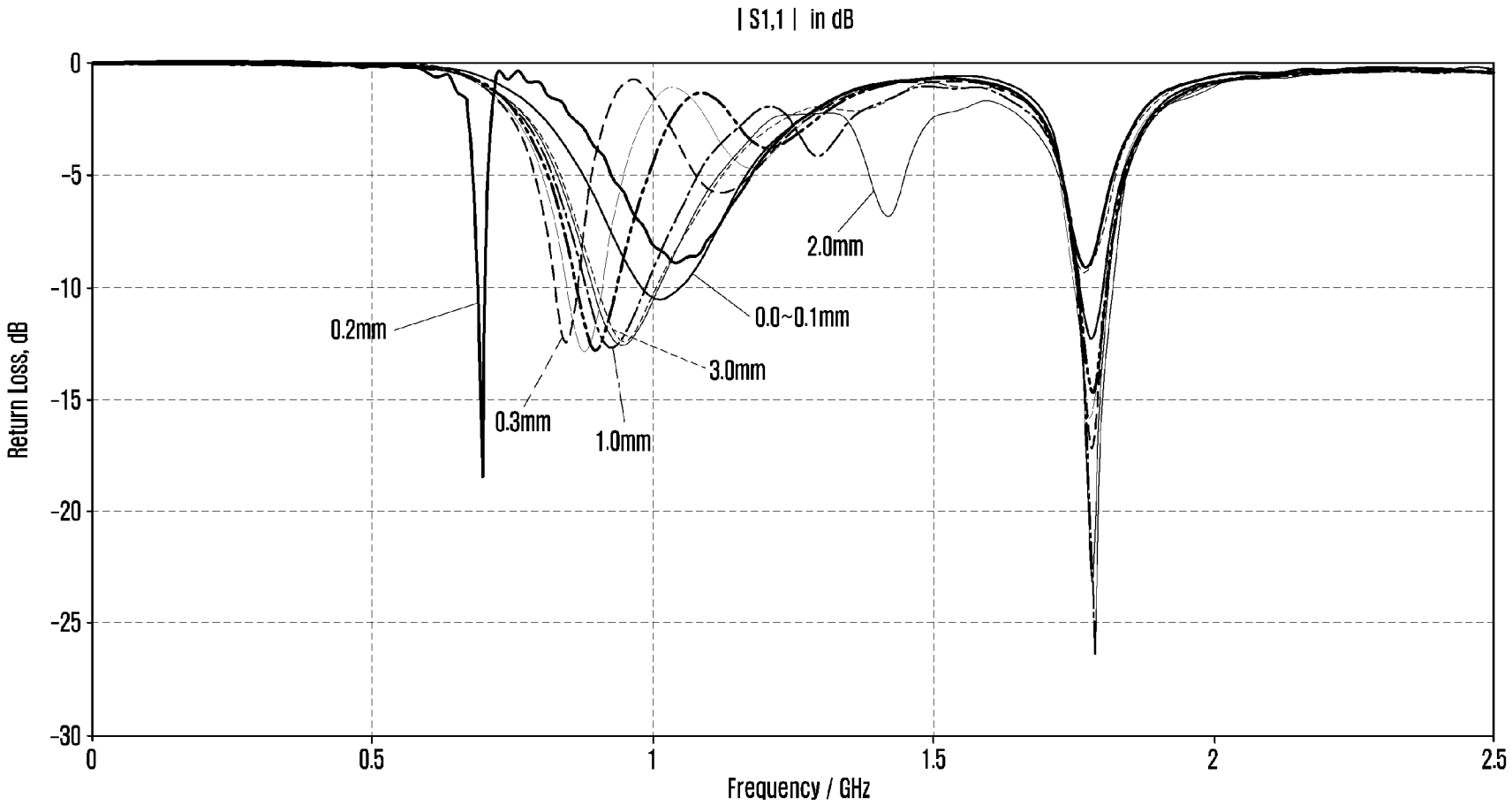
FIG. 7 is a graph that represents of a change in resonance frequency by tuning according to an embodiment of the present disclosure.

FIG. 4 is a view illustrating an antenna structure according to an embodiment of the present disclosure, FIG. 5 is a view illustrating a distribution of currents at a time of antenna radiation according to an embodiment of the present disclosure. FIG. 6 is a graph that compares a resonance frequency of an antenna according to an embodiment of the present disclosure with a resonance frequency of an antenna according to the related art. FIG. 7 is a graph that represents of a change in resonance frequency by tuning according to an embodiment of the present disclosure.

Referring to FIG. 4, the antenna according to an embodiment of the present disclosure may be mounted on a non-ground region adjacent to a PCB substrate 100. For example, according to various embodiments of the present disclosure, the antenna may be mounted at a lower end region of the electronic device.

The PCB substrate 100 may be a laminated substrate in which dielectric layers and metal plating layers are alternately and repeatedly laminated. A ground portion 110 may be constituted by the uppermost metal plating layer, and the non-ground region may be a fill cut region from which a part of the uppermost plating layer of the PCB substrate 100 is removed. As for the metal plating layers, metal materials such as gold, silver, nickel, copper, aluminum, and/or the like may be used. Among the aforementioned metal materials, copper is most widely used due to the reason of cost.

According to various embodiments of the present disclosure, the antenna may be configured as, for example, PIFA antenna. The PIFA antenna refers to an antenna that may receive an electromagnetic wave in air or radiate an electromagnetic wave to the air, using a circuit transmission line that is formed when an electric signal supplied from a PCB is transmitted to a radiator through a power feeding unit and the electric signal transmitted to the radiator is returned to the PCB through a ground. The PIFA antenna has an "F" shape in general and may match a coverable band width to a mobile communication band (e.g., 3G, 4G, and/or the like) and a value-added communication band (e.g., GPS, WiFi, Bluetooth, and/or the like).

In addition, according to various embodiments of the present disclosure, the antenna may be at least one of an antenna in which an antenna circuit is formed on a PCB substrate by etching, an antenna that executes radiation through a radiator formed in a Z-axis of a PCB by laminated PCB substrate layers and a via hole, an antenna formed through metal pattern plating, an antenna produced by rear welding, an antenna formed using a FPCB, a Laser Direct Structuring (LDS) antenna, an antenna produced through dual injection molding, and/or the like.

According to various embodiments of the present disclosure, the antenna may be at least one of an antenna having a frequency band equal to or higher than 1.56 GHz like Bluetooth, Global Positioning System (GPS), and/or WiFi, an antenna that is in charge of communication of Global System for Mobile communication GSM (GSM), Code Division Multiple Access (CDMA), and/or Wideband Code Division Multiple Access (WCDMA), and/or the like.

According to various embodiments of the present disclosure, the antenna of the present disclosure may include a ground portion 110, a radiator 120, a power feeding unit 130, a ground path 200, and an impedance matching element 210. The ground path 200 may be configured to form a spacing L between the ground path 200 and the expanded ground 140.

The radiator 120 may be described in the same concept as an antenna pattern, an antenna radiator, and a radiator pattern. For example, the radiator 120 is mounted on one side of a rear case of an electronic device, and is preferably disposed to be spaced apart from a battery by a spacing such that an antenna gain is not affected by the battery. The radiator 120 may be mounted on a PCB substrate or a carrier in a welding type or an in mold type and formed by at least one of an Ag paste, a copper paste or a compound material thereof, and/or the like.

In addition, the radiator 120 may implement a single band antenna in a type of a monopole antenna to which a ground line is connected or a PIFA type single band antenna to which a ground line is positioned at a position in the vicinity of a power feeding line.

The power feeding unit 130 is connected between the PCB substrate 100 and the radiator 120 to supply a power from the PCB substrate 100 to the radiator 120. When the power is supplied, a current may be transmitted to the radiator 120 through a power feeding unit 130. At this time, the antenna device forms a transmission line which is constituted with and circulates the radiator 120, the ground portion 110, and the ground path 200 based on the power feeding unit 130. In addition, using the transmission line circulated as described above, the radiator 120 receives an electromagnetic wave or radiates an electromagnetic wave to the air.

In particular, according to various embodiments of the present disclosure, the radiator 120 is mounted to be overlapped with the expanded ground 140 so as to mount an electric object or a circuit object such as a connector. For example, the radiator 120 and the expanded ground 140 may be provided at the lower end of the electronic device to be partially overlapped on a plane or a vertical line. A ground path 200 is employed in order to prevent a problem of causing a change in current flow in the ground portion 110 due to the construction as described above.

For example, the present disclosure employs the ground path 200 that causes the current flowing in the ground portion 110 to flow to a new current path before the current is distributed by the expanded ground 140.

The ground path 200 may extend from the ground portion 110 to a region adjacent to the expanded ground 140 and may be portioned at a fill cut region adjacent the ground portion 110. The ground path 200 may be constituted, but not exclusively, with the uppermost metal conductive layer of a laminated printed circuit board such as the ground portion 110, a metal conductive layer printed on a circuit board, a metal conductive layer mounted on a carrier, and/or the like.

The ground path 200 may be configured in at least one of various forms of, for example, a loop, a meander track, a spiral track, and/or the like. According to various embodiments of the present disclosure, in addition to or as an alternative to the aforementioned forms, any construction may be employed if such a construction may cause a current flowing in the ground portion 110 to a new current path so that the current is not distributed.

The ground portion 110 is connected to one end of the radiator 120 to ground the radiator 120.

Meanwhile, the antenna generates resonance at a specific frequency in which the resonance frequency of the antenna device at which the resonance is generated is greatly influenced by the physical length of the radiator 120.

As a result, various embodiments of the present disclosure may employ an impedance matching element 210 that affects the physical length of the radiator 120 in order to tune the resonance frequency of the antenna.

For example, various embodiments of the present disclosure variably changes the length added to the radiator 120 using the impedance matching element 210 thereby increasing an electrical length from the physical length of the radiator 120 so that the resonance frequency may be moved. The length given by the impedance matching element 210 may be adjusted by a designer.

The impedance matching element 210 may be connected with one end of the ground path 200. For example, the impedance matching element 210 may be provided between the one end of the ground path 200 which is opposite to a portion extending in a loop form from the ground portion 110 and the ground portion 110.

The impedance matching element 210 may be configured by an interdigital circuit, a lumped element, a chip element, and/or the like. Specifically, the impedance matching element 210 may be a capacitor, an inductor, a circuit configured by a combination of the inductor and the capacitor, may be configured by a circuit configured by a diode, an FET and a BJT which are active elements, a combination of RF passive and active elements, a combination of interdigital circuits, and/or the like.

For example, when the capacitance of the capacitor connected to the one end of the ground path 200 increases, the lower band resonance frequency antenna may move to the higher side. When the connection configuration and the capacitance value of the capacitor are adjusted through such an antenna, the lower band resonance frequency may be adjusted. The capacitor may have a configuration in which a plurality of capacitors are connected in series or in parallel, or capacitors of which the capacitances are different from or equal to each other are connected.

In addition, according to various embodiments of the present disclosure, the antenna may execute additional tuning in relation to a set resonance frequency using adjustment of a spacing L between the ground path 200 and the expanded ground 140. For example, according to the adjustment of the spaced distance L between the expanded ground 140 and the ground path 200, the resonance frequency of the antenna may be adjusted.

For example, a resonance frequency change phenomenon caused when the inherent dielectric constant of the radiator 120 was changed under the influence of a dielectric component of the expanded ground 140 may be compensated by adjusting a spacing L between the ground path 200 and a dielectric material mounted on the expanded ground 140. For example, a method of tuning the resonance frequency using the interaction between the dielectric component of the expanded ground 140 and the dielectric component of the ground path 200 may be employed.

For this purpose, the ground path 200 may be arranged at a position at which the ground path 200 induces a resonance frequency of the antenna, which was changed by a change of a surrounding environment, to be changed to a pre-set resonance frequency again.

Various embodiments of the present disclosure disclose an example in which the ground path 200 is arranged on one side of the expanded ground 400. However, in some cases, the ground path 200 may be arranged on the other side or on each of both sides.

FIG. 5 is a view illustrating a distribution of currents at a time of antenna radiation according to an embodiment of the present disclosure. For example, FIG. 5 is a view illustrating a current flow in an antenna of the present disclosure when resonance occurs according to an embodiment of the present disclosure.

Referring to FIG. 5, when a current is supplied to the power feeding point 130, the current flows into the antenna through the power feeding point 130 and the radiator 120, and the current flowing through the antenna may be radiated from the radiator 120. In addition, the antenna may form a transmission line that circulates the radiator 120, the ground portion 110, the ground path 200, and the impedance matching element 210 based on the current supplied to the power feeding point 130. In addition, the resonance frequency that is determined by the length of the radiator 120, the impedance matching element 210, and the spacing L between ground path 200 and the expanded ground 140 is generated.

According to various embodiments of the present disclosure, when the ground is expanded to a region at which the antenna is mounted, the antenna employs or is otherwise configured with the ground path 200 which is a new current path so that the current that has flown through the ground portion 110 may smoothly flow through the ground path 200 before the current is distributed at the expanded ground 140. As a result, the antenna may maintain the antenna length value by the current which has flown through the ground portion 110 and the antenna may resonate at a pre-set resonance frequency.

FIG. 6 is a graph that compares a resonance frequency of an antenna according to an embodiment of the present disclosure with a resonance frequency of an antenna according to the related art. For example, FIG. 6 illustrates a return loss of an antenna that employs a ground path adjacent to the expanded ground as illustrated in FIG. 4 according to an embodiment of the present disclosure.

Referring to FIG. 6, a GSM 900 MHz band in the graphs of comparing a resonance frequency of an antenna according to an embodiment of the present disclosure and antennas according to the related art will be discussed. The reflection coefficient of graph 620 corresponding to the antenna positioned at a region at which an expanded ground is not added is ideally smallest, and the reflection coefficient of graph 600 corresponding to an antenna positioned at a region at which the expanded ground is added is largest. This exhibits a problem of deforming the pre-set resonance frequency of the antenna due to the expanded ground.

It may be seen that the graph 610 corresponding to the antenna according to an embodiment of the present disclosure that employs the ground path of the antenna at a region adjacent to the expanded ground has a reflection coefficient which is reduced as compared to graph 620 corresponding to the antenna that does not apply the ground path.

According to various embodiments of the present disclosure, the ground path which is a new current path employed at the ground portion in the state in which the expanded ground is added smoothens the current flow as described above. For example, a current corresponding to the opposite polarity of the current flowing in the antenna is caused to flow through the ground portion and the ground path so that the ground portion and the ground path play a role corresponding to an antenna length value. As a result, a mono antenna that requires a half length as compared with a dipole antenna may be normally driven.

FIG. 7 is a graph that represents of a change in resonance frequency by tuning according to an embodiment of the present disclosure. For example, FIG. 7 illustrates a change characteristic of a resonance point depending on a change in spaced distance between the ground path 200 and the expanded ground 140 of the antenna having the configuration as illustrated in FIG. 4 according to an embodiment of the present disclosure.

Referring to FIG. 7, when the spacing L between the ground path 200 and the expanded ground 140 is changed from 0 to 3.0 mm at 0.1 mm intervals, the resonance frequency may be tuned as in the graph illustrated in FIG. 7.

It may be seen that, when the spacing L between the ground path 200 and the expanded ground 140 is 0.0 to 0.1 mm, the resonance frequency of the antenna is about 1 GHz, when the spacing L is 0.2 mm, the resonance frequency of the antenna is about 0.7 GHz, and as the spacing L is increased over 0.2 mm, the resonance frequency of the antenna gets close to the resonance frequency at the time when the spacing L is 0.0 mm.

According to the graph illustrated in FIG. 7, it may be seen that the antenna device according to an embodiment of the present disclosure may change the resonance frequency by changing the spacing L between the ground path 200 and the expanded ground 140 as well as using the physical length or an electric circuit (lumped element). In addition, it may be seen that, when the ground path 200 is employed, the return loss of the resonance frequency may be improved.

While the present disclosure has been show and described with reference to the various embodiments thereof, it will be understood by those skilled in the art that various changes in form and details may be made therein without departing from the spirit and scope of the present disclosure as defined by the appended claims and their equivalents.

What is claimed is:

1. An electronic device with an antenna device, the electronic device comprising:

a radiator configured to transmit/receive an electromagnetic wave;

a ground portion connected to one end of the radiator, the ground portion configured to conduct current such that a current corresponding to an opposite polarity of a current, which flows in the radiator, flows in the ground portion;

an expanded ground extending from a part of the ground portion; and a ground path extending from the ground portion to a region adjacent to the expanded ground so as to cause current to flow from the ground portion through a current path corresponding to the length of the radiator.

2. The electronic device of claim 1, wherein the ground portion is constituted by an uppermost metal plating layer of a laminate substrate in which dielectric layers and metal plating layers are alternately and repeatedly laminated.

3. The electronic device of claim 1, wherein the expanded ground portion extends from the ground portion to a fill cut region adjacent to the ground portion.

4. The electronic device of claim 1, wherein the ground path is provided adjacent to a side surface of the expanded ground in a fill cut region adjacent to the ground.

5. The electronic device of claim 1, wherein the ground path is provided in a form of at least one of a loop form, a meander track form, and a spiral track form.

6. The electronic device of claim 1, wherein the ground path further includes, at one end, an impedance matching element that tunes a resonance frequency of the antenna.

7. The electronic device of claim 1, wherein a spacing between the ground path and the expanded ground is adjusted according to a pre-set resonance frequency of the antenna.

8. The electronic device of claim 1, wherein the antenna device is a monopole antenna.

9. An antenna device comprising:

a radiator configured to transmit/receive an electromagnetic wave;

a ground portion connected to one end of the radiator, the ground portion configured to conduct current such that a current corresponding to an opposite polarity of a current, which flows in the radiator, flowing in the ground portion; and a ground path arranged to be adjacent to a region at which a part of the ground portion is expanded so as to cause the current flowing from the ground portion to flow to a new current path before being distributed by the expanded region.

10. The antenna device of claim 9, wherein the ground path further includes, at one end, an impedance matching element that tunes a resonance frequency of the antenna device.

11. The antenna device of claim 9, wherein a spacing between the ground path and the expanded ground is adjusted according to a pre-set resonance frequency of the antenna.

12. The antenna device of claim 9, wherein expanded region of the ground portion extends to be overlapped with the radiator.

13. The antenna device of claim 12, wherein the ground path is arranged so as to overlap with the radiator.

* * * * *